United States Patent [19]

Russell

[11] Patent Number: 4,653,438

[45] Date of Patent: Mar. 31, 1987

[54] ROTARY ENGINE

[76] Inventor: Robert L. Russell, 17337 S. Oconto, Tinley Park, Ill. 60477

[21] Appl. No.: 831,048

[22] Filed: Feb. 14, 1986

Related U.S. Application Data

[63] Continuation of Ser. No. 583,816, Feb. 27, 1984, abandoned.

[51] Int. Cl.[4] ..... F02B 57/08

[52] U.S. Cl. ..... 123/44 B; 123/44 E

[58] Field of Search ..... 91/498; 123/43 C, 44 B, 123/44 E, 55 AA, 58 AA, 43 AA

[56] References Cited

U.S. PATENT DOCUMENTS

| | | | |
|---|---|---|---|
| 593,078 | 11/1897 | Beyer | 123/44 B X |
| 769,363 | 9/1904 | Toliver | 123/44 B |
| 775,759 | 11/1904 | Franzen . | |
| 904,219 | 11/1908 | Patrick | 91/498 X |
| 951,388 | 3/1910 | Conill | 123/44 B |
| 986,021 | 3/1911 | Moore . | |
| 1,087,240 | 2/1914 | Kellington . | |
| 1,122,972 | 12/1914 | Maye . | |
| 1,252,757 | 1/1918 | Williams . | |
| 1,282,824 | 10/1918 | Hartson | 123/44 B |
| 1,324,408 | 12/1919 | Ragot . | |
| 1,456,479 | 5/1923 | Atkinson et al. | 123/44 B X |
| 1,485,988 | 10/1923 | Michel . | |
| 1,533,514 | 1/1923 | Ragot . | |
| 1,889,641 | 11/1930 | Dainton . | |
| 2,014,672 | 7/1938 | Schmaljohann . | |
| 3,673,991 | 7/1972 | Winn | 123/58 A |
| 3,942,488 | 3/1976 | Phillips et al. . | |
| 4,149,498 | 4/1979 | Ferrell | 123/58 AA |
| 4,387,672 | 6/1983 | Crocker | 123/55 AA |

FOREIGN PATENT DOCUMENTS

| | | | |
|---|---|---|---|
| 505829 | 9/1930 | Fed. Rep. of Germany . | |
| 718647 | 3/1942 | Fed. Rep. of Germany . | |
| 647815 | 8/1928 | France | 123/58 AA |
| 730546 | 5/1932 | France | 123/58 AA |

*Primary Examiner*—Michael Koczo

*Attorney, Agent, or Firm*—McCaleb, Lucas & Brugman

[57] ABSTRACT

A four cycle internal combustion, rotary engine is disclosed in which a cylindrical rotor having plural arcuately spaced, radially extending, piston carrying cylinders is mounted about a coaxially aligned central combustion chamber and main bearing for rotation therewith about a stationary main bearing support shaft which incorporates a fuel intake and exhaust manifold communicating with the combustion chamber and individual cylinders. A pair of stationary cam plates having registeringly aligned asymmetrical cam tracks are mounted in parallel spaced relation adjacent opposite axial ends of the rotor; the tracks thereof being simultaneously engaged by cooperating pairs of follower rollers slidably coupled to pistons in each of the cylinders in a manner requiring movement of the pistons radially of the rotor in response to rotational movement of the latter about the main bearing shaft. During each rotational cycle of the rotor each piston completes a four cycle operation of intake, compression, combustion and exhaust strokes in which the intake and compression strokes are selectively unequal to the combustion and exhaust strokes in accordance with a selected configuration of the cam tracks whereby to effect maximum fuel efficiency and power output for the engine in accordance with the characteristics of the selected fuel of combustion. A modified form of the engine is disclosed wherein each cam plate provides a pair of radially spaced cam tracks engageable by individual rollers to positively control movement of the pistons radially of the rotor.

8 Claims, 15 Drawing Figures

68
68
70
64
70
136
58
58
138
60
71
71
59
138
144
144
128
126
56
62
174
69
89
122
173
88
120
124
113
87
118
119
106
IN
172
86
93
92
110
112
EXHAUST
90
91
54
108
87
176
89
130
88
158
160
134
144
144
136
131
59
132
60
66

ROTARY ENGINE

This is a continuation of co-pending application Ser. No. 06/583,816, filed on Feb. 27, 1984, now abandoned.

This invention relates generally to rotary internal combustion engines and more particularly to improvements therein for achieving greater fuel economy and power output.

In the familiar reciprocating piston engine used extensively today having pistons coupled to a rotatable crank shaft, the piston stroke is limited by the orbit of the crank shaft. As a consequence the combustion or power stroke of each piston is only as great as the compression stroke thereof so that when a cylinder's exhaust valve is opened, unspent fuel and gases are allowed to escape to atmosphere resulting in the loss of useable power. Similar impact is encountered in the limitation of the exhaust stroke in such engines to the orbit of the crank shaft. This limits the available time during which the exhaust gases may be expended from the cylinder. In consequence there is a loss of power due to back pressure of the exhaust gasses as each piston moves to the high point of its stroke.

Aside from the noted limitations on the power and exhaust strokes of such engines, utilization of an elongated manifold for distributing air/fuel mixtures to the several cylinders thereof leads to inefficiencies of fuel mixing and distribution largely brought about by the necessity of periodically opening and closing the intake valves to the cylinders, thereby interupting the flow of fuel mixture to the cylinders. This leads to uneven delivery and combustion of the fuel mixture to and within the individual cylinders, creating uneven running of the engine.

Another area of disadvantage in the conventional four cycle engines resides in the fact that the four strokes of operation for each piston and cylinder, namely intake, compression, combustion and exhaust require two revolutions of the crank shaft for completion. That is to say, for each two revolutions of the crank shaft there is only one combustion or power stroke for each piston. This results in increased RPM's and attendant friction loss and wear and tear on the moving parts for a given horsepower output. Due to the fact that the conventional four cycle internal combustion engine employs a large number of friction producing parts, such as springs which must be compressed, bearings, cams which must be rotated or seals which rub tightly to restrict rotation of the engine, the resulting friction power loss is not available for output horsepower.

While there are other factors and inefficiencies which detract from the overall capability of presently known four cycle internal combustion engines to produce maximum horsepower with minimum fuel consumption, the foregoing indicate the principal areas of disadvantage which the present invention is intended to alleviate.

In brief, the improved engine of the present invention embodies a rotatable cylinder block or rotor carrying a plurality of arcuately spaced, radial cylinder and piston assemblies which communicate at their radially innermost ends with a rotatable combustion chamber that rotates with the rotor about a non-rotatable, fixed main bearing shaft comprising fuel intake and exhaust manifold means for distributing air/fuel mixtures to and exhausting expended gases from the cylinders. Movement of the various pistons in their respective cylinders is unlimited by a fixed crank shaft orbit inasmuch as asymmetrical cam means are employed for that purpose. Consequently the piston strokes for the various cycles of intake, compression, combustion and exhaust may be selectively varied and unequal in length and duration by changing the cam configuration. Thus the combustion or power stroke and the exhaust stroke may be considerably greater than the intake and compression strokes. By reason of an increased power or combustion stroke, the engine of this invention has the ability to use more of the available combustion gases to produce usable horsepower. This increase in the power stroke is limited only by the overall size of the engine and the available compressed gasses of combustion. As a result virtually all of the compressed gases may be used for the purpose of producing usable power outside the engine as opposed to the conventional crankshaft engines which are limited in efficiency by the restrictive length of the crank shaft radius of orbit.

As a corollary to the increased power stroke the engine of this invention also is fully capable of converting pressurized gases of combustion into usable rotary power due to the fact that the force or pressure of the combustion gases is applied directly against a smooth and ever declining angle of the cam means. Thus the gases are usable to their maximum advantage with regard to the leverage applied for rotating the cylinder block. Long camming angles are available for this purpose to produce a constant, smooth, and even leverage action productive of rotary power. As gas pressures increase the camming leverage is at a minimum, gradually increasing as the expanding gas pressure decreases. This opposing action gives the engine an improved characteristic of substantially constant force application in converting rectilinear piston movement into rotary movement of the output shaft.

As the pressures of the combustion gases are expended the exhaust gases must be expelled from the engine and, again, because the engine of this invention utilizes cam actuated piston movement, the camming angle is capable of being decreased in the exhaust mode to provide maximum time for exhaust gasses to escape the confines of the cylinders. This leads to less back pressure against the pistons and a resulting lowered power loss from that factor.

In addition to the improved power and exhaust strokes, the cam actuated piston design provides improved engine breathing during the intake cycle principally because the engine rotates about a stationary manifold and main bearing shaft so that there is a near constant or non-interrupted flow of fuel and air into the cylinders of the engine. This improved intake activity provides better distribution of fuel in the air fuel mixture and results in more even and powerful combustion within the cylinders.

Importantly the design of the engine of this invention permits completion of all four cycle modes necessary for complete fuel combustion and exhaust within each 360° of rotor rotation. Thus each cylinder of the rotating cylinder block assembly fires for each complete rotation of the cylinder block rotor. Consequently the engine of this invention is capable of producing increased horsepower at lower revolutions per minute or, by changing the appropriate angles of the cam means and the length of piston stroke the engine may conversely produce lower horsepower at higher RPM.

In addition to the advantages in the areas of breathing, combustion and power output, the engine of this invention also exhibits great advantage in the area of minimizing internal power loss due to friction inasmuch as the engine rotor rotates freely on precision bearings and exhibits very little friction loss by virtue of coupling the cam means with the individual pistons of the engine.

Because the rotor cylinder block of this engine is relatively freely rotatable, it additionally exhibits a marked flywheel effect which permits the engine to produce horsepower higher than the engine's rated capacity for short periods of time. This characteristic is useful, for example, in applications such as an automobile, particularly at start-up, when initially engaging the engine to the drive shaft. This flywheel effect allows the horsepower requirements for an application like an automobile to be reduced so as to size down the engine and provide greater fuel economy.

It is a principal object of this invention to provide an improved internal combustion engine having a rotatable cylinder block carrying a plurality of pistons which are coupled to continuous asymmetrical cam track means for controlling the reciprocating movement of such pistons.

It is another important object of this invention to provide an improved rotary internal combustion engine in which the power and exhaust strokes of the pistons for a four cycle operation are selectively different than the intake and compression strokes thereof.

Still another important object of this invention is to provide a rotary internal combustion engine in which successive intake, compression, power and exhaust strokes are accomplished for each 360° of revolution of a rotatable cylinder block.

It is a still further object of this invention to provide an improved internal combustion engine having a rotatable cylinder block capable of imparting fly wheel effect energy to the engine.

Another important object of this invention is to provide a rotary internal combustion engine having a rotatable engine block, carrying cam actuated reciprocating pistons and improved means for transferring force between the pistons and stationary cam means.

Still another object of this invention is to provide an improved internal combustion engine in which a cylinder block carrying a plurality of pistons and cylinders moves rotatably with a combustion chamber about a stationary intake and exhaust manifold.

Another important object of this invention is to provide a rotary internal combustion engine exhibiting improved flow of combustible fuel mixtures to the individual cylinders for ignition therein.

Still another important object of this invention is to provide an improved rotary internal combustion engine capable of variation in the intake, compression, power, and exhaust strokes of the reciprocating pistons thereof to produce maximum power and fuel efficiency and in accordance with combustion characteristics of a variety of liquid or gaseous fuels.

Still another important object of this invention is to provide an improved rotary internal combustion engine exhibiting economies of manufacture, operation, and maintenance.

An additional important object of this invention is to provide an improved rotary internal combustion engine which is lightweight, compact and capable of delivering higher than normal ratios of usable horsepower to fuel consumption.

Having described this invention, the above and further objects, features, and advantages thereof will appear from time to time from the following detailed description of preferred and modified forms thereof illustrated in the accompanying drawings and representing the best mode currently contemplated for enabling those of skill in the art to practice this invention.

IN THE DRAWINGS

DESCRIPTION OF THE PREFERRED EMBODIMENT

Figure 1:
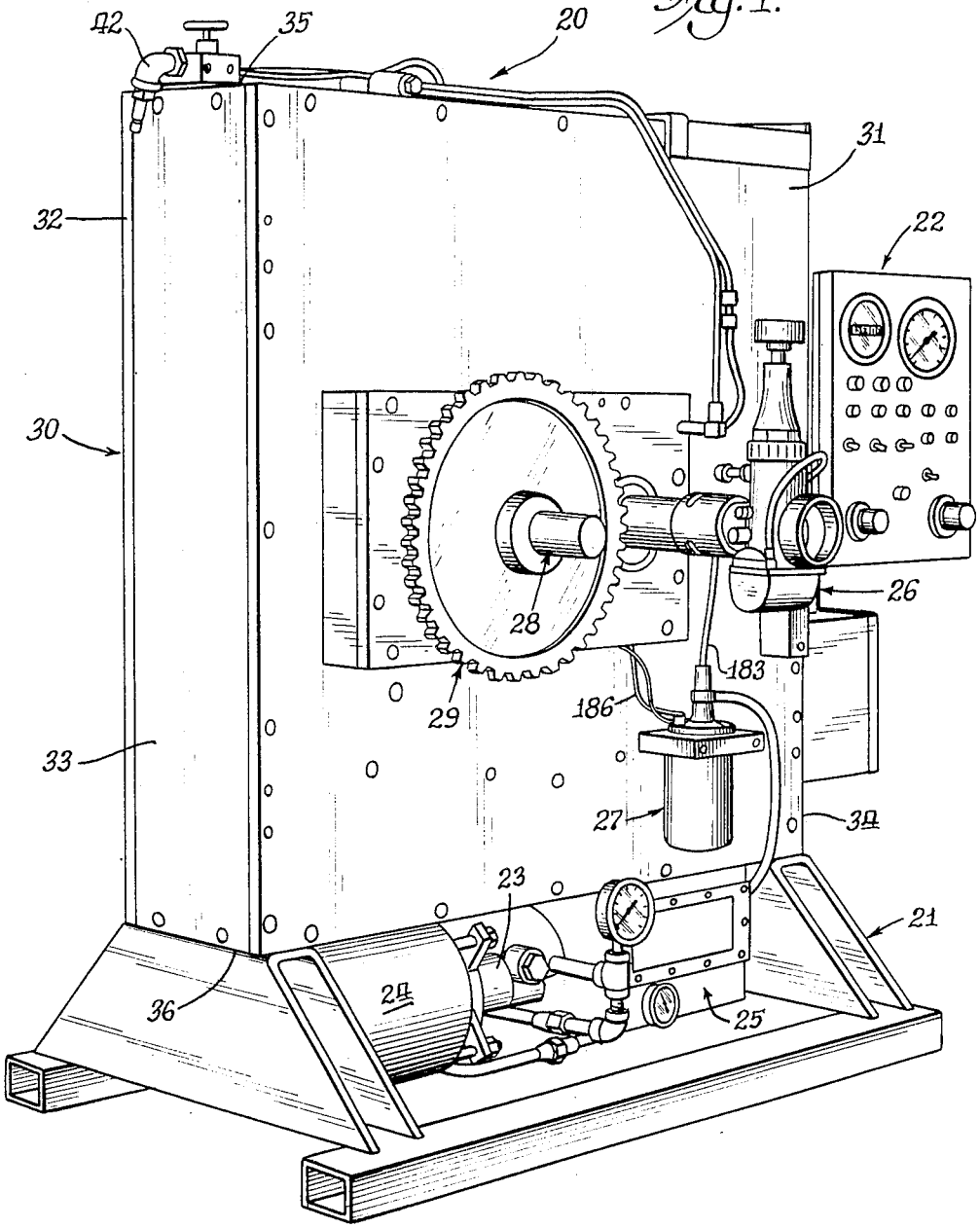
FIG. 1 is a perspective view of a rotary engine in accordance with the present invention.

In FIGS. 1 through 11 of the drawings features of a working prototype engine 20, illustrative of the present invention, are set forth. As shown in FIG. 1, engine 20 is shown mounted on a test stand 21 equipped with a control panel 22. A sump pump 23, driven by motor 24 is associated with an oil sump well 25 mounted on the underside of the engine. The engine 20 is equipped with a carburetor 26, spark coil 27, output shaft 28 and starting gear 29 adapted for connection with a suitable starting motor (not shown) to effect initial actuation of the engine's pistons for starting purposes.

As shown, engine 20 comprises a generally rectangular parallelopiped outer casing 30 having parallel front and back walls 31 and 32, respectively, mounted over parallel side walls 33, 34 and top and bottom walls 35 and 36 to effect an enclosure for the working elements of the engine to be described more fully hereinafter. It is to be understood, of course, that the particular configuration of the casing 30 is relatively immaterial to the present invention other than to illustrate a protective outer covering and support for the working elements of the engine.

Figure 2:
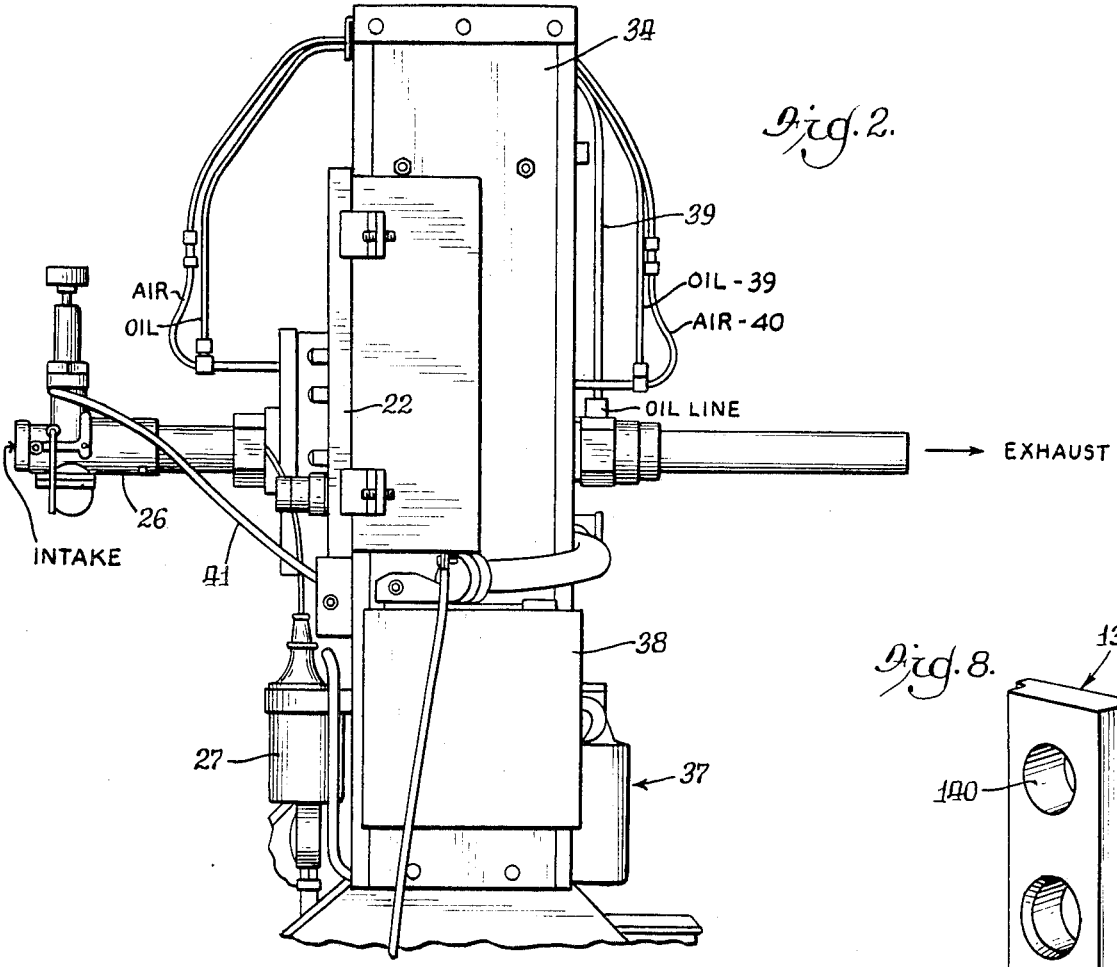
FIG. 2 is a partial right hand end elevation of the engine illustrated in FIG. 1.

As shown in FIG. 2 also mounted exteriorly of the casing 30 is an oil filter 37, a 12 volt power supply 38 adjacent the control panel 22, and a network of oil and air lines 39 and 40, respectively, for lubricating the interior working elements enclosed by the casing. A suitable fuel supply line 41 connected to an appropriate fuel tank (not shown) is also provided for supplying combustible fuel, such as gasoline, to the carburetor 26. It will be appreciated that the oil lines 39 communicate between the oil sump 25 via the oil filter 37 and appropriate zones of the engine as will be described in greater detail hereinafter. Similarly, the air lines 40 are coupled to a suitable source of compressed air via fitting means 42 (see FIG. 1) in the particular embodiment illustrated. It is to be understood that while the basic lubricating and cooling system depicted in the enclosed drawings comprises a combination of mixed air and oil, the engine is capable of being lubricated by pressurized oil alone or by air in combination with localized oil lubrication.

In brief, in accordance with the cooling and lubricating system illustrated, pressurized air and oil are injected as a misty atmosphere into the enclosed interior of the casing 30 where they are circulated principally by the fan effect of the rotating engine block rotor, throughout the casing. A filter means 44 (see FIG. 3) serves to trap oil mist from the circulating air which exits from the engine casing via openings 45, 45. Condensed oil collects in the bottom of the casing and returns to the oil tank sump 25 via drain means 46 in the casing bottom wall 36. Again such details are of no particular moment to this invention other than to establish the need for appropriate cooling and lubricating systems for the engine's working elements.

Figure 3:
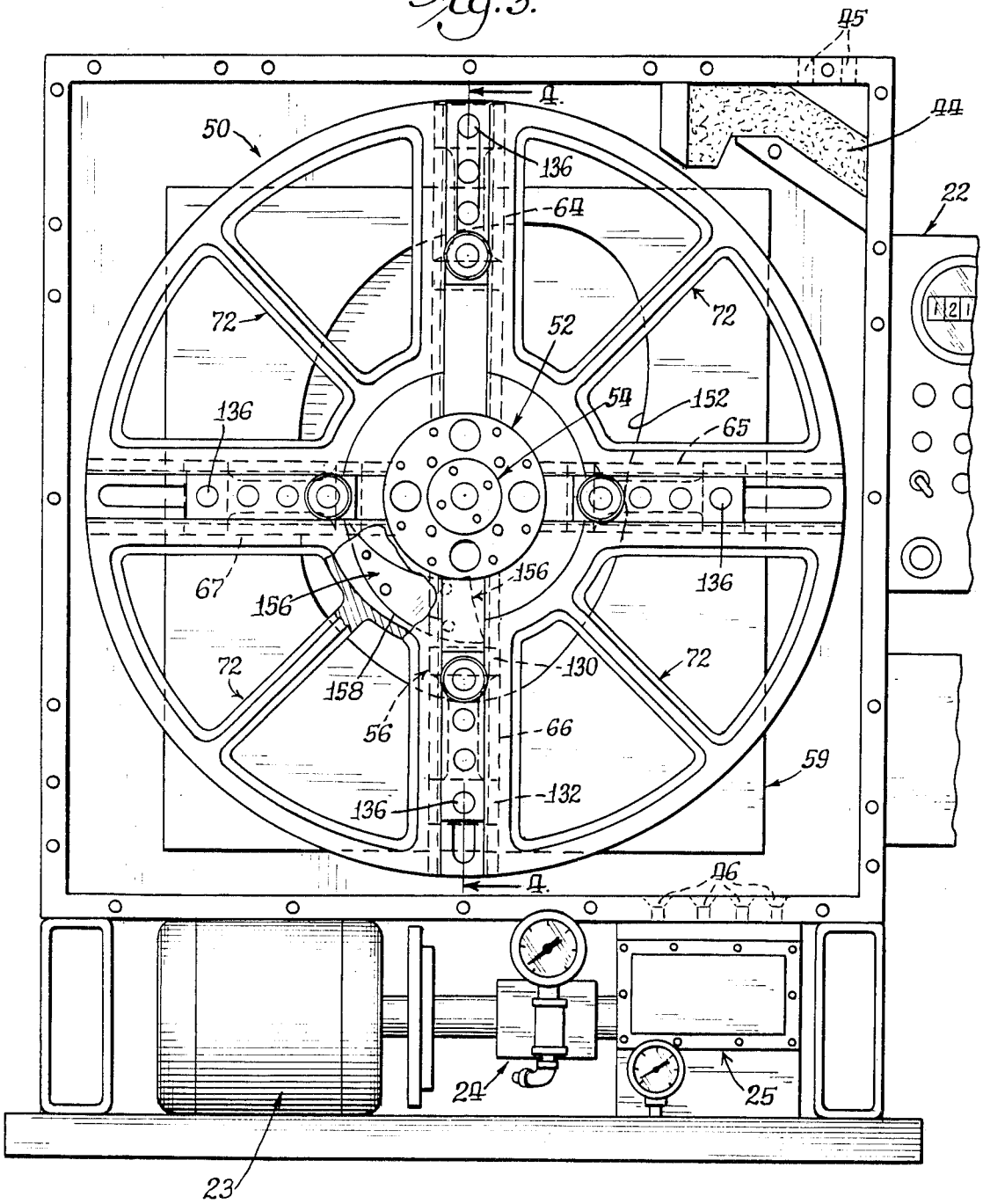
FIG. 3 is an enlarged front elevation with housing cover removed illustrating the interior arrangement of parts for the engine illustrated in FIG. 1.
Figure 4:
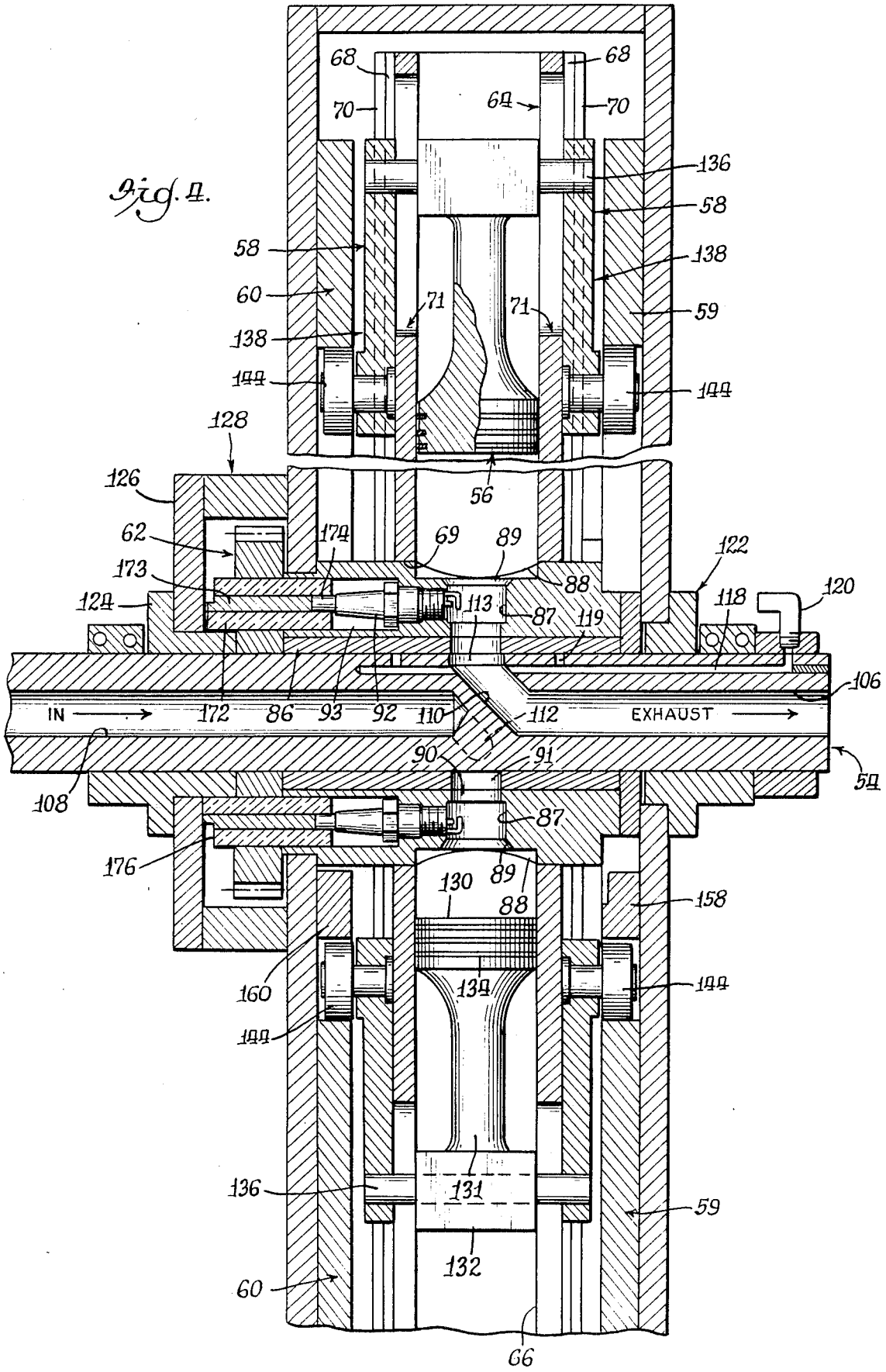
FIG. 4 is an enlarged foreshortened cross-sectional view with parts in elevation, taken substantially along vantage line 4—4 of FIG. 3 and looking in the direction of the arrows thereon.

Turning now to features of the major working elements of the engine, specific reference is made to FIGS. 3 and 4 of the drawings. In general there are eight main elements or means involved in engine 20 which are arranged and combined for converting the explosive energy of fuel combustion to usable power available at the output shaft 28. In brief these comprise a main cylinder block rotor means 50 and a bearing and combustion chamber means 52 which is coaxially interlocked with the rotor and provides the main bearing support therefor during its movement about a combined main bearing shaft and intake and exhaust manifold means 54. Each of the cylinders provided in the rotor means 50 houses a rectilinearly movable reciprocating piston means 56 slidably coupled by cam rider assemblies 58 to a pair of parallel stationary cam means 59 and 60.

The organization of the above-listed elements is such as to effect rotatable activity or motion of the rotor means and reciprocating activity of the piston means carried therein in accordance with the configuration of the cam means whereby to rotatably drive a primary drive gear means 62 affixed to the outer end of the combustion chamber means 52. As noted such enumerated means 50 through 62 are supported within or on the casing 30 and constitute the major working elements of the engine which will now be described in detail.

ROTOR MEANS

The rotor means 50 is basically a cylindrical fly wheel cylinder block in which one or more cylindrical bores are provided along arcuately spaced radial axes to form piston cylinders. In the embodiment illustrated herein, four such radially disposed piston cylinders 64, 65, 66 and 67 are provided. It should be noted that the permitted number of cylinder bores is determined only by the available space in the rotor and the particular power requirements of the engine. Within such parameters an engine according to this invention may comprise one or more cylinders. Adjacent each cylinder bore and running parallel to and on opposite sides thereof, in the front and back faces of the rotor, are a pair of registeringly aligned parallel spaced cam slide grooves 68,68 receptive of a pair of cam rider assemblies 58 associated with each piston means 56. Cam slide grooves 68 extend from the outer periphery of the rotor to a central bored opening 69 therein (see FIG. 4) which is coaxially receptive of the combustion chamber means 52. The side walls of each groove 68 are undercut to provide overhanging lip portions 70 bordering the lateral sides of such groove whereby to interlock the cam rider assemblies in such grooves.

Within the outer $\frac{1}{3}$ diameter of the rotor are elongated slotted openings 71 aligned with the center line of the cam slide grooves 68 and each of the cylinder chambers. Such openings 71 extend into the adjacent cylinder chamber for the purposes of affording connection of the piston means 56 therein with associated cam rider assemblies 58, as will appear presently. Between each of the cylinders 64–67, areas of the rotor may be cut away as shown to provide intermediate web spokes 72, or such intermediate areas may be left solid as desired.

It will be appreciated that each of the cylinders 64 through 67 communicates openly with the outer periphery of the rotor 50 and the central bore 69. It also will be understood that in the construction of the rotor 50 the mass thereof is evenly distributed about its central axis to effect static and dynamic balance of the rotor whereby to avoid vibration in operation.

While not shown in the drawings, the central bore 69 of the rotor is provided with a keyway for interlocking connection with the combustion chamber means 52 as will now be described.

COMBUSTION CHAMBER

Figure 6:
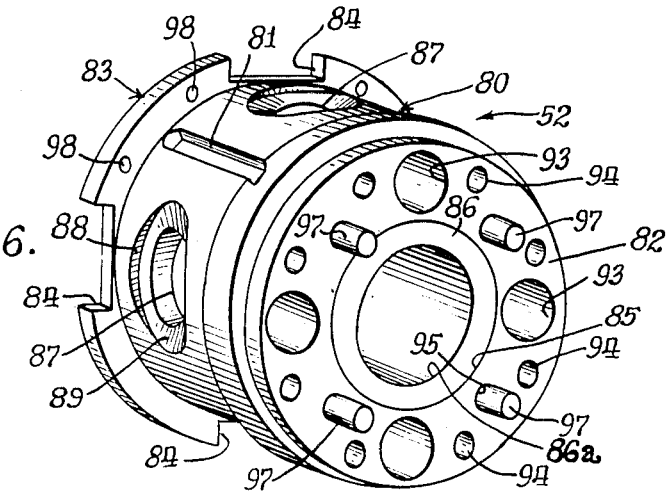
FIG. 6 is a perspective view of a main bearing support and combustion chamber which is mounted coaxially of the rotor.

With particular reference to FIGS. 3, 4 and 6 of the drawings, the features of the combustion chamber and main bearing support will be recognized. Combustion chamber means 52 is a multi-purpose part in that it supports the rotor means 50 and rotates with that member on and about the combination stationary main bearing shaft and intake and exhaust manifold means 54 (see FIGS. 3 and 4). As best shown in FIG. 6, the combustion chamber means 52 is formed with a cylindrical main body portion 80 provided with an elongated keyway 81 cut into one side thereof parallel to its longitudinal axis. Body portion 80 has an end wall portion 82 partially enclosing one end thereof; the opposite end thereof being partially enclosed by a parallel flanged end wall portion 83 having an annular flange extending radially outwardly of the circumference of the main body portion 80 and distinguished by four U-shaped notches or cut out areas 84, 84 located at 90° intervals thereabout. These cut out areas or notches 84 are provided for the purpose of clearing the cam rider assemblies 58 in operation, as will be described more fully hereinafter. The two end wall portions 82 and 83 are distinguished by a large central cylindrical bore 85 extending coaxially through body portion 80 for receiving the stationary main bearing shaft and manifold means 54 along with a main cylindrical sleeve bearing 86 (see FIG. 4) which is pressed into bore 85 in assembly.

The cylindrical main body portion 80 of member 52 is further distinguished by four bored openings 87 extending radially inwardly from the outer surface thereof to communicate with the central shaft receptive bore 86*a*, as indicated in FIG. 6. Each of these bores 87 radially intersects the central axis of the member 52, is aligned centrally of one of the cut out areas 84 and has a cylindrical counterbore at its outer end to provide a shallow cup-shaped chamber portion 88 coaxially of the opening 87 and interjoined with the latter via a chamfered frustoconical shoulder area 89. The radially innermost end of each bored opening 87 communicates with a transverse oval opening 90 having an elongated axis paralleling the elongated axis of the combustion chamber member 52 and communicating with the shaft 54 via registeringly aligned oval openings 91 formed in the main bearing 86 in assembly. The superposed openings 90, 91 act as valve means in operation as will appear presently. Each of the bored openings 87 and the adjacent bored areas 88,89 described, comprises an individual combustion chamber communicating with one of the cylinders 64 through 67 with which it is coaxially aligned in assembly. Accurate coaxial alignment of the combustion chambers and the four cylinders 64–67 is accomplished by mating a key with the keyway means 81 on the exterior surface of the body portion 80 of member 52 and the keyway provided in the central enlarged opening 69 of the rotor.

Each combustion chamber is invaded by a spark plug 92 threaded into a bored opening 93 extending inwardly of the outer end 82 of member 52 parallel to the latter's longitudinal axis; such spark plugs having the gapped electrodes thereof openly invading the combustion chambers formed by the bore portions 87–89 (see FIG. 4). The outer end 82 of the member 52 is also provided with twelve openings 94, 94 and 95, 95 receptive of appropriate fasteners for joining the main drive gear 62 coaxially to the outer end of the member 52 in assembly; gear 62 being fastened to end wall 82 by eight machine bolts 96, 96 (see FIG. 10) and aligned by means of four locating pins 97, 97 projecting outwardly of openings 95. The opposite flanged end wall portion 83 of the combustion chamber means 52 is similarly joined to the rotor means 50 by eight machine bolts (not illustrated) extending through appropriate openings 98 formed in the annular flange portion thereof as shown best in FIG. 6.

As previously indicated accurate alignment between the four combustion chambers and the several cylinders is achieved by interlocking key and keyway means formed in member 52 and the central bore of the rotor; the combustion chamber means 52 being press fitted into the central opening 69 of the rotor with the key and keyway means aligned and engaged as noted. In consequence the rotor 50, the combustion chamber means 52 and main bearing 86 are conjointly rotatable about the main shaft and manifold means 54.

INTAKE AND EXHAUST MANIFOLD

The intake and exhaust manifold means 54 serves the general purpose of supporting the rotatably movable rotor means 50 and its fixedly associated combustion chamber means 52 and main bearing 86 for movement thereabout. It also serves to deliver air/fuel mixtures to the individual combustion chambers and to convey exhaust gasses from the cylinders.

Figure 7:
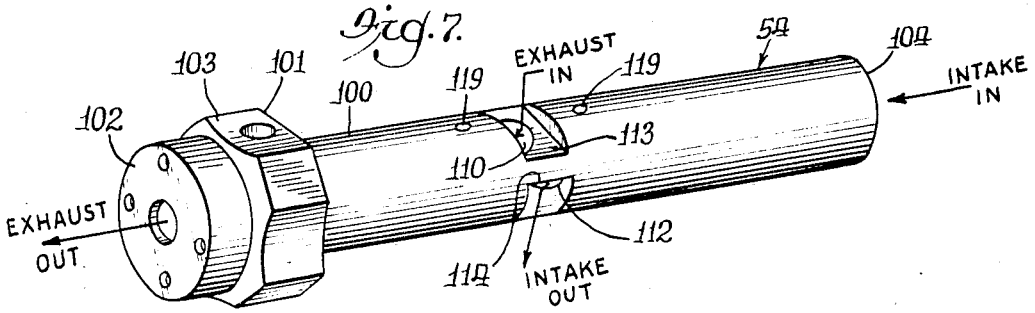
FIG. 7 is a perspective view of the combined main bearing shaft and intake and exhaust manifold member about which the cylinder block is rotatable.

Particulars of the exhaust manifold means 54 will best be understood from FIG. 7 of the drawings taken in conjunction with FIG. 4. As there shown, member 54 comprises an elongated cylindrical shaft body 100 having an integral collar portion 101 adjacent one outer end 102 thereof and which is provided with wrench engaging flat surfaces 103 whereby the shaft 54 may be manually rotated for adjustment purposes as will be explained more fully hereinafter. The opposite end 104 of member 54 is provided with threaded openings (not shown) receptive of machine screws whereby the carburetor means 26 may be attached coaxially thereto.

Two large coaxial bores are formed inwardly of the opposite ends of the shaft member 54 to extend partially along the length thereof as indicated at 106 and 108 (see FIG. 4). Bore 106 is intersected at its inner end by secondary bore 110 disposed at 45° to the axis thereof. The outer end of the slanted bore 110 is intersected by a milled out slot or flat area 113 formed parallel to the longitudinal axis of the member 54. In a similar fashion the central bore 108 is intersected at its inner end by a secondary slanted bore 112 which in turn is intersected by a flattened area 114. The two flattened areas 113 and 114 constitute exhaust and intake valve ports, respectively, which do not intersect in any respect (see FIG. 7) and which cooperate with the oval openings 90, 91 associated with each combustion chamber.

The shaft 54 is also provided with internal lubricating passageway means 118 having one or more outlets 119 (see FIG. 4) communicating with the main bearing 86 and having a supply fitting 120 formed at collar portion 101 for purposes of lubricating the bearing 86 as the latter moves about the stationary shaft 54; fitting 120 being joined to oil line 39.

As shown best in FIG. 4, the interconnecting bores 106 and 110 constitute the exhaust passageway system for the engine while bore 108 and its intersecting bore 112 constitute the main air intake passageway system for supplying fuel and air mix to the combustion chambers 87. From FIG. 4, it will be recognized that shaft 54 is coaxially inserted within the main bearing 86 coaxially of the combustion chamber 52 and the rotor 50 with the exhaust and intake ports thereof aligned by rotating shaft 54 so that the slotted valve ports 113 and 114 align with the oval openings 90 and the correspondingly aligned openings 91 in the bearing member 86 in accordance with the intake and exhaust cycles for the several pistons and cylinders of the engine.

In order that the shaft 54 be held in a fixed and non-rotatable condition after adjustment, two shaft clamp numbers 122 and 124 are mounted over and clamped to the outer ends of the shaft member 54; clamp 122 being bolted to the back casing wall member 32 while clamp 124 is similarly fastened to a front cover wall 126 of an auxiliary casing 128, disposed centrally of the engine casing's front wall member 31. With this arrangement, as the rotor 50 moves about the shaft 54 along with the combustion chamber 52, the individual combustion chambers 87, coaxially aligned with their respective cylinders 64 through 67, move sequentially into communication with the ports 113 and 114 at selected points of the rotational cycle for rotor 50. It is to be noted that the combustion chambers and their cylinders are sealed off by the solid outer cylindrical wall of shaft 54 intermediate the ports 113 and 114. Thus the valving system for the engine is provided. It is to be noted that with this arrangement the intake port 114 is in communication with one of the four cylinders of the engine at all times so that the flow of fuel and air mixture is uninterruped by the valving means to provide a steady flow of fuel mixture through the passageways 108, 112. This promotes fuel economy and a smooth running engine. The same holds true with respect to the exhaust passageways 106, 110 to promote uninterrupted outflow of spent exhaust gases.

PISTONS

The pistons 56 in accordance with this invention are best shown in FIG. 4 of the drawings as comprising a one-piece construction in which head portion 130 thereof is formed integrally with connecting rod and cross head portions 131 and 132, respectively. The head portion of course, is of cylindrical formation while the crosshead is generally of rectangular configuration having semi-cylindrical ends where the same meet the cylinder walls so as to act as guide means for movement of the pistons in and along the cylinder chambers. The head portion 130 also is provided with three annular rings 134, two of which are compression rings and the third of which is an oil ring to promote lubrication of the cylinder walls. The rings 134, of course, are mounted in appropriate grooves cut for that purpose about the circumference of the cylindrical piston head portion 130. The crosshead portion 132 is provided with a central cylindrical bore extending to the longitudinal axis of the piston for reception of a mating connecting pin 136 by which the pistons are coupled to associated cam rider assemblies 58. As mentioned heretofor, in the illustrated embodiment shown there are four pistons, one disposed in each of the cylinders 64 through 67 for rectilinear reciprocation coaxially of such cylinders and each piston is coupled to a pair of cooperating cam rider assemblies 58 as will now be described in detail.

CAM RIDER ASSEMBLIES

Figure 8:
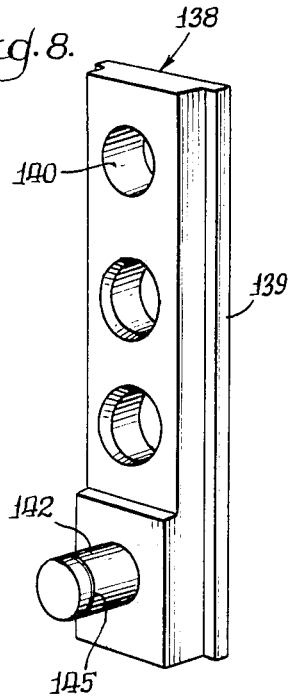
FIG. 8 is a perspective view of a slide member associated with the cam rider assemblies illustrated in FIG. 3.

As best shown in FIGS. 4 and 8 of the drawings, each of the cam rider assemblies 58 comprises an elongated, substantially rectangular rigid slide member 138 formed with parallel spaced linear rail portions 139 extending along the lateral flanks or margins thereof for sliding reception beneath the lips 70 in the slide grooves 68 provided on opposite sides of each cylinder, as previously described. The cam rider assemblies, as previously noted, are the means by which the rotor develops its rotating power and to this end the connecting pins 136 extend outwardly of opposite ends of the crosshead portion 132 of each piston and through the slotted openings 71 in the cylinder walls for press fitted engagement with cylindrical openings 140 formed adjacent the outer end of each slide member 138 of a cooperating pair thereof (see FIGS. 4 and 8). The pins 136 lie in parallel spaced relation to the longitudinal axis of the main bearing shaft 54 and are loosely received in the slotted openings 71. Interconnection of the pins 136 with the slide members 138 rigidly couples such members together so that when the slides move the piston also moves within the confines of its cylinder and vice versa. Engagement of the rail portions 139 with the slide grooves 68 is a loose slide fit to permit easy movement of the slide members along the slide grooves in the rotor.

Adjacent the lower end of each slide member 138 is mounted a headed pin member 142 which projects laterally beyond its associated slide member to provide a mounting stud on which a cam follower roller 144 is mounted. Each roller 144 is held in place by a snap ring (not shown) receptive in a snap ring groove 145 formed adjacent the outer end of pin member 142. Each cam follower roller 144 constitutes a bearing assembly of standard construction comprising an outer ring movable about and on rotatable roller bearings held in a hub race member in accordance with known practice.

As shown, in assembly a pair of the bearing member rollers 144 are located adjacent opposite sides of the head end 130 of each piston with the associated rollers 144 being coaxially aligned. Thus each piston is effectively supported on rollers 144 by a rigid yoke system comprising a pair of slide members 138 and a cross connecting pin means 136.

Such cam rider assemblies are the means by which the straight line force produced from the combustion of fuel against the piston head in each of the cylinders is converted into desired rotary action of the engine block to rotate the drive gear means 62. This conversion activity is brought about by virtue of the roller bearings 144 being pushed outwardly by the piston after combustion which forces the rollers to ride on declining planes provided by the cam means 59 and 60; the thrust of the follower roller bearings against the cam means causing the free wheeling rotor assembly 50 to reactively rotate and develop desired rotory power.

CAM MEANS

Figure 5:
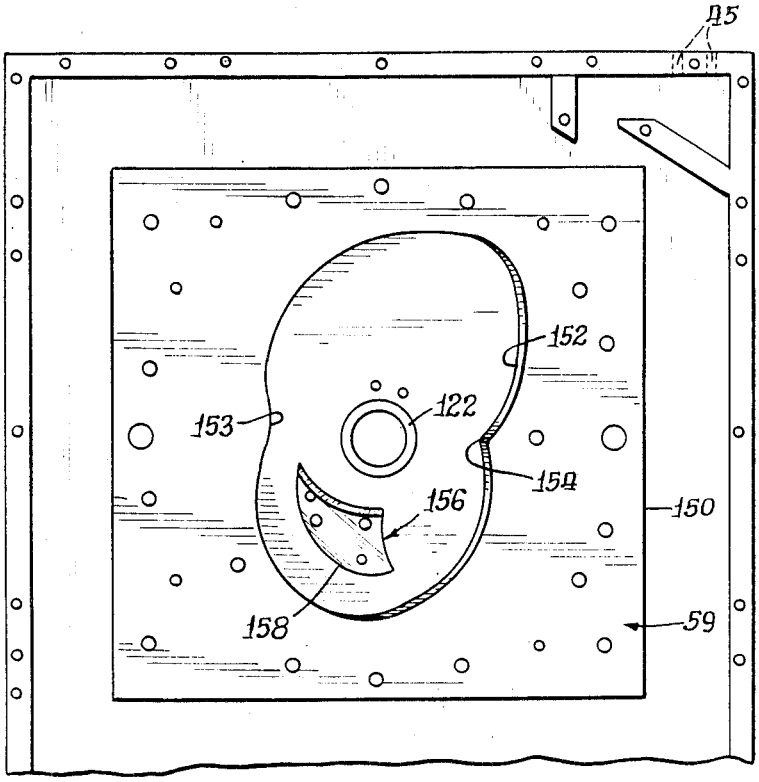
FIG. 5 is a partial front elevation, similar to FIG. 3, but at a reduced scale thereover with rotor removed to illustrate the features of associated cam means.

Features of the cam means 59–60 will best be understood from FIGS. 3,4, and 5 of the drawings. Inasmuch as the cam means 59 and 60 are identical insofar as camming contours and construction are concerned, the two being mere reflections of one another to accommodate their mounting in parallel spaced registry, the description which follows will be concerned primarily with cam means 59 with the understanding that corresponding features of cam means 60 are the same.

With special reference to FIGS. 3 and 5, it will be understood that the cam means 59 illustrated therein comprises a generally square shaped heavy metal plate 150 suitably bolted to the back cover wall 32 of the engine casing in coaxial alignment with the shaft means 54 and the rotor means 50. Cam means 60 is similarly fixed to front casing wall 31 in registry with cam 59. In general as best noted from FIG. 5, the plate 150 is cut out centrally to provide an asymmetrical peripheral cam track 152 of continuous contour which is engagable by the follower rollers 144 in operation. In the particular embodiment illustrated the track 152 is formed to provide four distinct operations of the pistons, the movements of which are responsive to the engagement and movement of the cam roller means 144 with and along the cam track.

In brief, track 152 is distinguished by two lobe areas 153, 154 extending inwardly toward the central axis of the engine and cam plate 150, which axis is coincident with the axis of rotation for the rotor means 50. The high point of lobe 153 marks the point of initiating the intake stroke of the engine pistons and may be considered as the zero degree position of rotational movement for the rotor. Reading counter clockwise from this zero degree position to approximately 85 degrees, the camming angle of the track 152 declines or moves away from the central axis of the engine causing each piston to move radially outwardly from the rotor's axis of rotation in accordance with the following activity of the associated roller means 144 along track 152. This intake mode or cycle creates a vacuum atmosphere within the confines of the cylinder as the oval holes or openings 90, 91 of the associated bearing and combustion chamber approach and come into alignment with the intake port 112 provided in the main bearing shaft 54. As the rotor proceeds counterclockwise over the intake port, the piston draws in fuel/air mixture from the carburetor through the intake manifold passageways 108, 112, gradually closing the intake port 114 with respect to the involved cylinder as the rotor approaches 85 degrees of counter clockwise rotation.

It is to be noted that there is a supplementary part of cam means 59, labeled 156 in FIG. 5, which is disposed radially inwardly of the intake portion of track 152 to present a secondary cam track 158 in parallel spaced relation to the intake portion of cam track 152. A corresponding supplemental plate 160 is provided for cam means 60 in registering opposition to the plate 156 (See FIG. 4). These secondary cam plates are specifically designed to aid intake at engine starting when the RPM of the rotor is insufficient to create the necessary centrifical forces on the piston and its cam rider assemblies to follow track 152 and draw in a full air fuel charge into the cylinder. Other than the starting mode, the supplemental cam plate portions 156 and 160 do not come into play and are not normally engaged by the roller means 144 once the engine is in full operation.

The portion of the cam track 152 between the end of the intake stroke to the high point of the second lobe 154, (generally between 85 and 175 degrees of counter clockwise rotation measured from the high point of lobe 153) constitutes the compression stroke for each piston/cylinder assembly.

Compression is initiated as the oval openings 90, 91 of the affected cylinder and combustion chamber passes beyond intake passageway 112 and port 114 onto or opposite a solid part of shaft 54 intermediate the intake and exhaust port openings thereof to seal off the cylinder and combustion chamber and prevent the loss of explosive mixture therefrom during compression. The gasses are compressed as the associated cam rider assemblies are forced up an inclining cam angle of ever increasing value. As the roller means 144 approaches lobe 154, the piston is forced in closer to the center line of the engine until it reaches full compression at approximately 175° of rotor rotation.

Following the compression stroke the next step in each piston/cylinder's operation is the combustion mode which occurs from approximately 175° to 237° of counterclockwise rotation. In this mode the piston in the cylinder is under full compression with the intake and exhaust ports in the main bearing shaft sealed so that upon electrically energizing the spark plug associated with the particular combustion chamber involved, the compressed fuel mixture within the sealed cylinder is ignited. When this occurs the piston is forced out and away from the central axis of the engine and its cam rider assemblies are driven against a now sharply declining angle of the cam plates, causing the rotor assembly to be rotatably driven.

Following the combustion stroke each piston/cylinder combination of the rotor assembly passes into the exhaust mode of its operating cycle which occurs from substantially 237° to 360° of counterclockwise rotation. As the rotor assembly moves a cylinder into this exhaust mode, the oval holes 90, 91 in the associated combustion chamber comes into communicating alignment with the exhaust port 113 in the main bearing shaft and the cam rider assemblies are moved along an inclining cam angle forcing the piston gradually inward toward the central axis of the rotor and the peak of lobe 153. This inward radial movement of each piston in response to movement of the cam follower roller assemblies associated therewith, forces the expended fuel and gases out of the exhaust port and manifold passageway 106, 110. The exhaust mode or stroke is completed as the rotor approaches 360° of counterclockwise rotation ready to repeat the above described four stroke cycle program.

The aforedescribed strokes or modes of operation of course occur for each of the four cylinder and piston assemblies of the illustrated embodiment, particular note being made of the fact that each piston completes a full four stroke cycle of operation namely intake, compression, combustion and exhaust for each 360° of rotor movement. Importantly it is to be recognized that the piston strokes as well as the duration of each operating stroke may be widely varied, if desired, as determined by the selected configuration of the cam tracks.

Such rotational driving of the rotor effects corresponding conjoint rotation of the main drive gear means 62 from which the power output of the engine is taken.

DRIVE GEAR

The features of the main drive gear means 62 will best be understood with reference to FIGS. 4 and 9 through 11 of the drawings. The drive gear has several functions. First, it supplies the means for taking power from the engine for delivery to the output shaft means 28. Secondly, it provides means for carrying insulators used to insulate the spark plugs 92 and insure minimum loss of electrical power to the spark plugs. In conjunction with the latter function it also acts as a cooperating part of the distributor means for effecting ignition of the spark plugs in proper sequence to the operating cycles of the engine.

Figure 9:
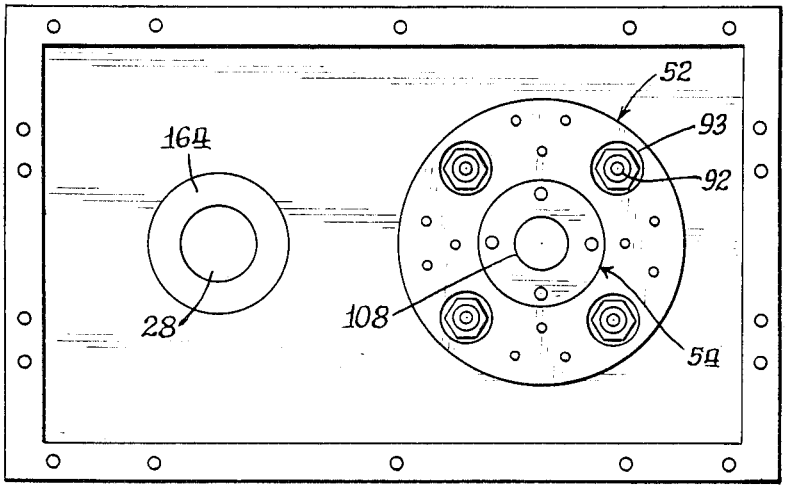
FIG. 9 is an enlarged front elevation illustrating the power output shaft and the fuel igniting spark plugs associated with the combustion chamber of FIG. 6.

For a better understanding of how the foregoing functions are accomplished, initial reference is made to FIG. 9 of the drawings which illustrates the combustion chamber means 52 in its assembled position on the intake and exhaust manifold means 54 with end 82 thereof extending through an appropriate opening in the casing wall 31 into the box-like auxiliary casing 128 fixed to the front face of the engine casing. It will be recalled that the combustion chamber means 52 has four bored chambers 93 formed inwardly of the outer end 82 thereof for reception of the four spark plugs 92 in the illustrated embodiment hereof (see FIG. 4). The spark plugs of course are threadedly engaged with the walls of the openings 93 as previously described with the gapped electrodes thereof disposed in associated individual combustion chambers for each of the four cylinders in the illustrated embodiment.

As is also shown in FIG. 9, the output shaft 28 is rotatably supported in and by bearing means 164 mounted in the casing wall 31 and partially supported by the adjacent cam plate 60 (not shown).

Figure 10:
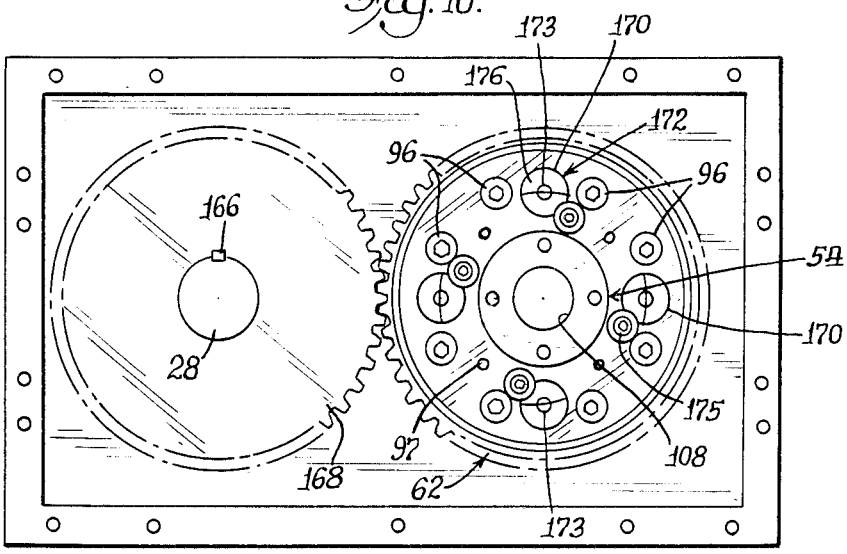
FIG. 10 is an enlarged front elevation similar to FIG. 9 showing the relationship of the power takeoff and timing gears.

Turning now to FIG. 10 of the drawings, the detailed aspects of the drive gear 62 will better be understood. It will be noted that gear 62 comprises a spur gear which is fixed to the outer end of the combustion chamber means 52 by bolt and pin means 96 and 97 for rotational movement with the rotor and combustion chamber. Mounted alongside the drive gear 62 and fixed to the output shaft 28 as by key and keyway means 166 is a timing gear 168 which in the particular instance illustrated, is the same size and diameter as the drive gear. The two gears have intermeshing peripheral teeth whereby they rotate at a 1 to 1 ratio relationship. This gearing ratio may be changed, of course, in accordance with desired rotational speed of the output shaft 28 within the skill of the art.

It will be observed that the drive gear 62 contains four large openings 170 which are registeringly aligned with the openings 93 in the combustion chamber means 52 and are designed to receive cylindrical insulators 172 having a central electrode or electrically conductive core member 173 mounted therein (see FIG. 4). Such insulator members fit over the outer electrode end of the spark plugs with the conductive core member 173 in contact with the connector electrode end 174 thereof, as best shown in FIG. 4. This establishes good and positive circuit contact between the spark plugs and the conductor core members 173. Suitable lock bolts 175 engage a projecting semi-circular end shoulder portion 176 of each of the insulators 172 to axially lock the same in their bores 170 and press the same tightly against the central connective electrode of the spark plugs. It will be recognized that with this arrangement the drive gear means 62, the spark plugs 92 and the combustion chamber 52 simultaneously move about a common axis in accordance with the movement of the rotor means 50.

In order to insure proper firing of the several spark plugs in accordance with the combustion stroke operation for each piston of the engine, it is necessary to provide means for timing the ignition of the spark plugs and for transferring electrical energy to the electrodes thereof. To this end it will be noted from FIG. 10 in particular, that the shouldered end portions 176 at the outer end of the insulators are semiarcuate, cutting through a portion of each of the conductive core members 173 thereof with such arcuate cut out areas being aligned at a common radius from the central axis of the shaft 54.

Figure 11:
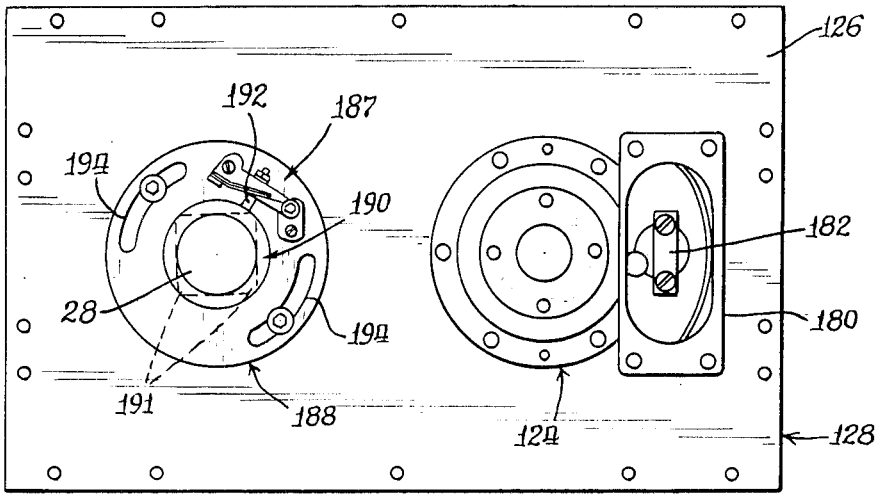
FIG. 11 is an enlarged front elevation of the distributor and ignition timing means associated with the drive gear and output shaft.

As shown in FIG. 11, over the outside cover 126 of the auxiliary housing 128 is mounted the shaft locking collar 124 which is securely bolted to the cover wall 126 as previously described. Locking collar 124 is cut away on one side to provide a straight line shoulder against which rests a distributor insulator and housing 180 having a conductive distributor contact member 182 mounted therewithin. Member 182 is joined by conductor 183 (see FIG. 1) to the spark coil 27 mounted exteriorly of the engine housing or casing 30 and is aligned opposite the path of movement for the conductive core members 173 carried by the drive gear. Additional conductors 186 lead from the coil 27 to a breaker point assembly 187 mounted on a rotatably adjustable timing plate 188 fixed to the front wall plate 126 of the auxiliary housing 128. The breaker points 187 are in operating engagement with a timing cam 190 mounted about the output shaft 28 and fixed thereto for coaxial rotation with the output shaft. It will be noted that the timing cam 190 provides four lobes 191 engagable with the follower 192 of the breaker point assembly 187. Thus for each rotation of the output shaft 28 the breaker points 187 are opened and closed four times corresponding to the combustion strokes of the four piston and cylinder assemblies in the illustrated engine.

The spark coil 27, of course, is connected to the 12 volt power supply 38 so that as the breaker points are opened and closed energy is sequentially delivered to the electrode 182 of the distributor assembly and transferred therefrom to the conductive core members 173 held by the insulator members 172 as members 173 move beneath electrode 182 with the rotatably driven drive gear 62. This distributes electrical energy to the respectively associated spark plugs in positive timed relationship to the rotation of the timing cam 190. Advance or retarding of the spark is achieved by rotating the timing plate 188 which is adjustably held in position by the bolt and slot means 194 as shown in FIG. 11. Thus ignition of the combustible fuel mixture within each of the cylinders is effected as desired.

Having described the various elemental portions and parts which go to make up the improved engine of this invention, it is to be noted that because of the unique cam and cam rider assemblies associated with each of the pistons, the latter are permitted a maximum stroke length while keeping the overall size of the engine to a minimum. Due to the fact that the follower rollers of the cam rider assemblies 58 are disposed adjacent the head end of the pistons, the point of force transfer between the follower rollers 144, located adjacent the innermost ends of the slide members 138, and the cam tracks of the two registeringly aligned cam means occurs as close to the center line of the engine as possible. This feature not only extends the length of available piston stroke, but permits much steeper angles in the cam track itself during the combustion cycle to produce more available rotating power while greatly reducing the rotational speed required of the rollers 144 as they engage and follow the tracks of the cam means. In addition, due to the provision of the cam slide members the loss of power which would normally be caused by the piston rubbing the sides of the cylinder is essentially eliminated since the pistons are guided rectilinearly by the cam slide members and cross heads so that there are no lateral forces on the pistons. Because of the absence of lateral forces acting on the pistons greater cylinder life and a better sealing action of the piston rings is brought about.

It is of further importance to note that the cam track may be widely varied. This coupled with the fact that all four strokes of piston/cylinder operation, namely, intake, compression, combustion and exhaust are accomplished during each 360° of rotation of the rotor assembly permits wide variation in designing the individual strokes both in duration and length of piston stroke. Such freedom of stroke design permits the engine to produce maximum power with maximum fuel efficiency. As an example, the intake and compression strokes may be only one half the length and duration of the combustion stroke to provide the utmost use of the expanded gases. On the other hand the exhaust stroke can be greatly extended to allow more time for spent gases to be purged from the engine thereby reducing back pressure on the pistons. Because of such available changes in the individual strokes inherent in the cam design, the engine of this invention is capable of efficiently burning and converting to rotating power virtually any rapidly expanding fuel such as gasoline, diesel fuel, alcohol, natural gas, hydrogen, propane, butane, etc. Not only is the engine capable of using and burning such fuels, but due to the flexibility of cam design available such burning and combustion can be carried out most efficiently. In addition, because of the capability of extending the combustion strokes, gases of combustion may be more completely consumed thereby reducing exhaust gas pollution.

FIRST MODIFIED FORM

Figure 12:
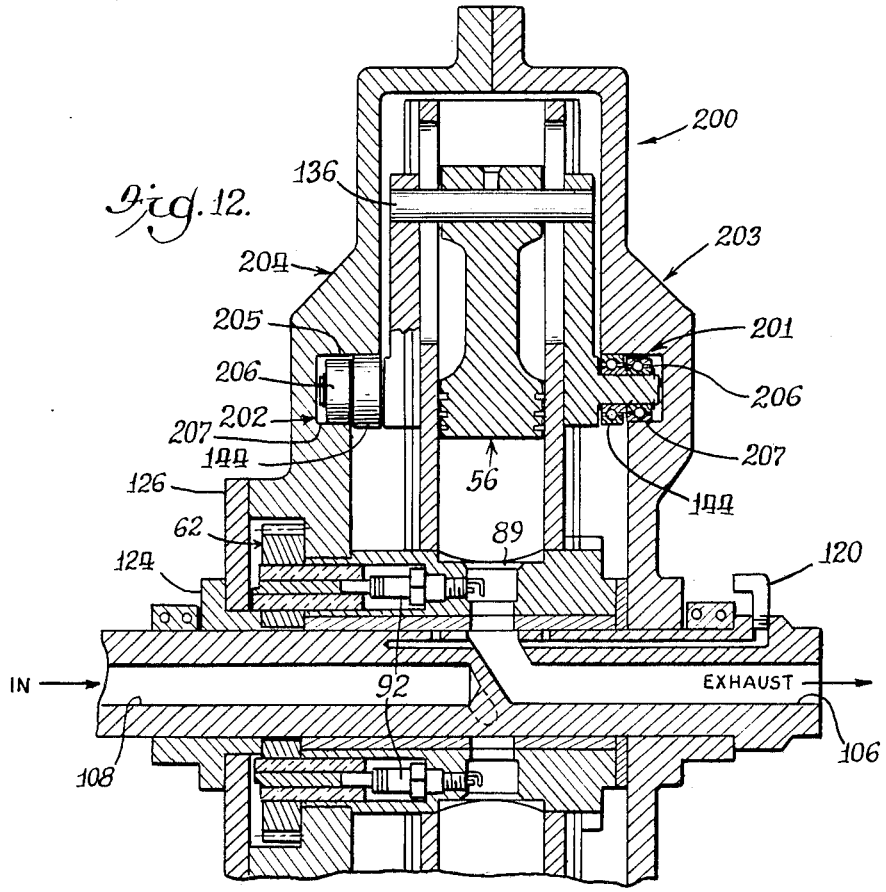
FIG. 12 is a partial cross-sectional view, similar to FIG. 4 of a modified engine of this invention.
Figure 13:
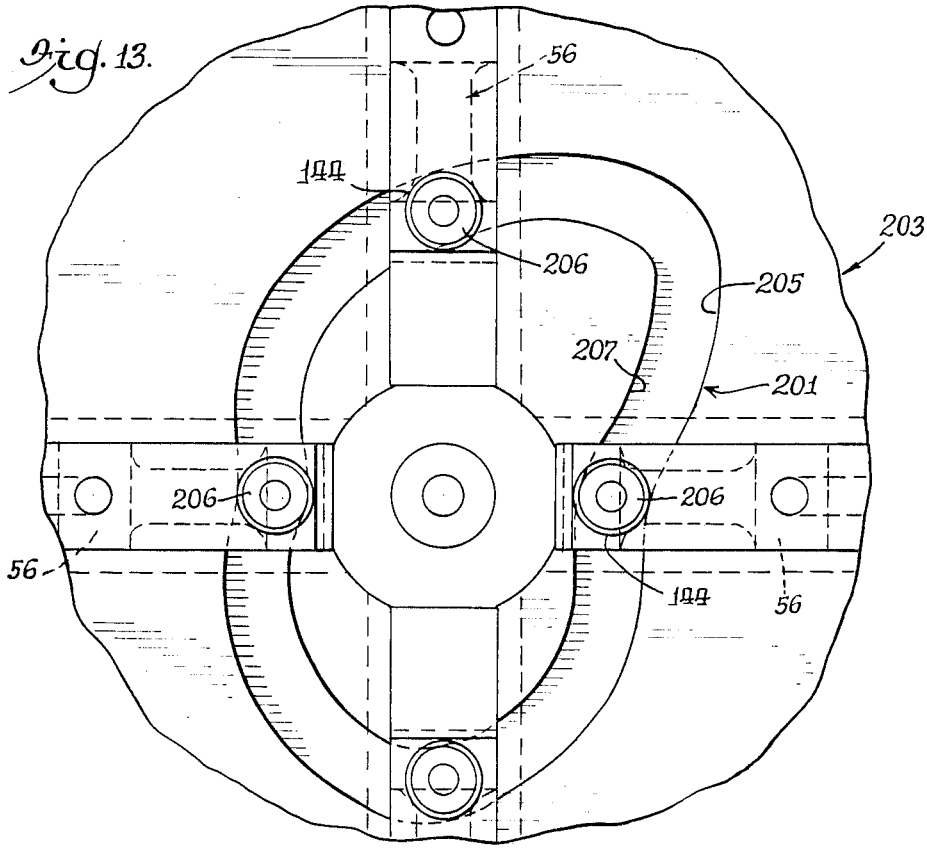
FIG. 13 is a partial front elevation of a modified dual track cam means employed in the engine of FIG. 12.

While the foregoing described basic engine of this invention, is efficient and versatile in its operation as noted, a modified version thereof, illustrating the major points of departure over the engine in FIGS. 1–11, is illustrated in FIGS. 12 and 13 of the drawings. As shown therein the modified engine 200, comprises a pair of stationary cam means 201 and 202 formed integrally with mating outer casing members 203 and 204, respectively. It will be recognized that the principle departure of this structure, over the first described engine 20 is in the provision of double cam tracks in each of the cam means 201 and 202. Roller means 144, as previously described, engage the outer cam track 205 i.e. the cam track disposed radially outermost from the central axis of the engine, while additional roller means 206 engage the radially innermost tracks 207. This provides a cam follower system which responds to positive push and pull action of the engine's pistons and makes for a relatively noise or clatter free operation of the engine, particularly when the pistons reverse their direction from inward to outward movement, relative to the center line of the engine. It also provides for positive control of the intake strokes which is no longer dependent on centrifical forces as in engine 20. Other than the redesign of the outer casing, the cam track means and cam follower assemblies, the modified engine 200 is substantially identical to engine 20 in all other respects.

SECOND MODIFIED FORM

Figure 14:
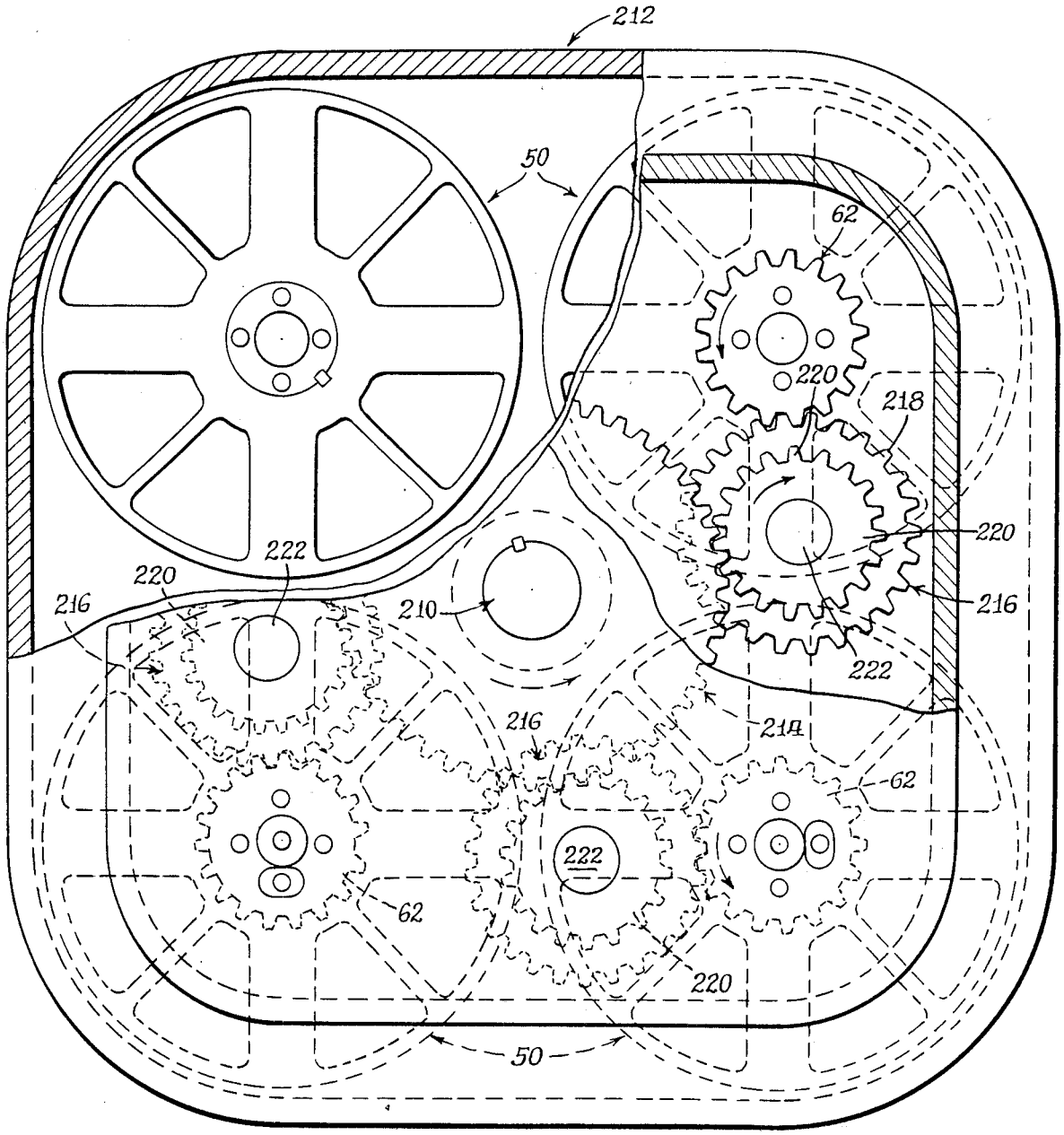
FIG. 14 is an end elevation with portions of the engine casing broken away showing a modified cluster engine employing four individual engines of the type illustrated in FIGS. 1 through 13.
Figure 15:
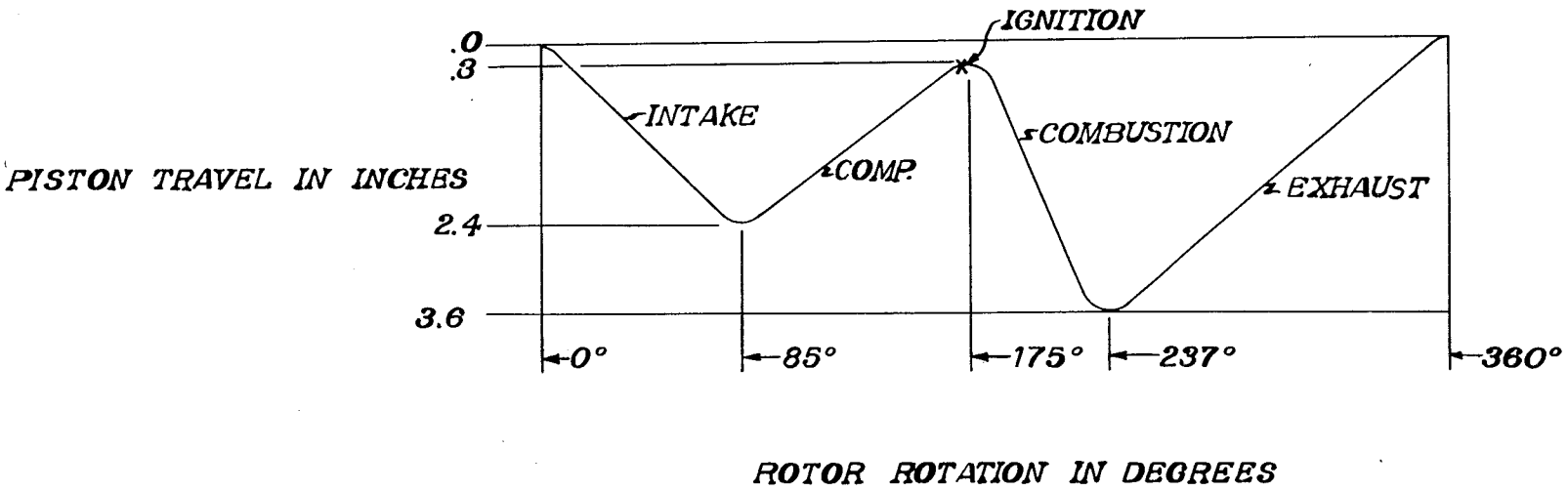
FIG. 15 is a graphic diagram illustrating piston travel versus rotor rotation of a rotary engine according to this invention.

In FIG. 14, the features of a second modification of the engines hereinabove described, namely a cluster arrangement of two or more engines 20 or 200 capable of being coupled to a single output shaft 210 is shown. Specifically in this modified showing an outer casing 212 mounts four individual rotor means 50, for example, arranged in four quadrants about a central output shaft 210. Each of the rotors is coupled to a central drive gear 214 which is keyed to the output shaft 210 over intervening speed clutch assemblies 216. Each clutch assembly basically comprises a pair of gears 218 and 220 of dissimilar diameter mounted on a common clutch shaft 222; gear 218 being engaged with the drive gear 62 of an individual engine rotor and the secondary clutch gear 220 being engaged with the common drive gear 214 coupled to the common output shaft 210. The arrangement of the slip clutch assemblies is such that if gear 220 rotates at a speed greater than that of gear 218 the clutch mechanism produces complete disengagement of the two clutch gears. If on the other hand the rotating speed of gear 218 is brought up to match that of gear 220 the clutch engages, locking gears 218 and 220 together and transferring torque to power gear 214 and power output shaft 210. It is to be noted that there are several other known means and methods by which the engagement and disengagement of the drive shaft can be accomplished such as locking pins, standard pressure clutches, etc. within the skill of the art.

Basically, the cluster engine of FIG. 14 is designed to provide a power plant in which the engine is capable of matching peak horse power requirements as well as meeting offload requirements while operating at a fraction of its potential power output. In brief, the multiple rotary engine of FIG. 14 permits two or more engine rotors 50 to be incorporated into one common engine while maintaining each rotor selectively independent of its partners. Consequently, it is possible to operate an engine of the character set out in FIG. 14 at selected levels of horse power output. For example, if it were to be assumed that each rotary engine were capable of producing 50 horse power, then an engine similar to that shown in FIG. 14, containing four rotors, would be capable of producing a total horsepower output of substantially 200 horse power. If, upon occassion, only 100 horse power were required, then only two of the four rotors would be required and the other two could be totally shut down allowing them to be at rest while the other two continued running, unencumbered by the two at rest rotors. In such a circumstance the at rest rotary engines could be maintained, tuned-up or similar operations performed without interruption of the engine's operation on the whole. By way of further example, if the average horse power requirement were only 50 horse power, then only one rotor would need to be activated at any one time and at regular intervals another rotor could then be activated instead of the first rotor, permitting the latter to rest, thus promoting longer engine life and more even wear of moving parts. In effect, a cluster engine of the character indicated in FIG. 14 provides the advantage of having an inbuilt back up system, so that in the event of a mechanical failure of any one rotary engine, one or more other engines are available and waiting to be put on the line.

Having described the engine of this invention and its modified forms as above set forth, it is believed that those skilled in the art will readily recognize and appreciate its novel advancement over prior engines of this general character and will further appreciate that while the present invention has been described in association with a preferred illustrated embodiment and its two modified forms, the same is susceptible to wide variation and modification without necessarily departing from the spirit and scope of this invention which is intended to be unlimited by the foregoing description except as may appear in following appended claims.

What is claimed is:

1. An internal combustion four cycle rotary engine comprising: a generally cylindrical having one or more acrcuately spaced cylinders, each carrying a piston therein extending radially of a central rotational axis of the rotor; stationary bearings support shaft means disposed coaxially of said rotor, unitary combustion chamber means carrying main bearing means for rotatably supporting the same on said shaft means and providing one or more individual combustion chambers, each indpendently communicating with one of said cylinders; said chamber means being mounted concentrically of said rotor and rotatably moveable therewith about said shaft means; plural cam means comprising a pair of registeringly aligned, axially spaced, continuously curvilinear cam track means which are formed radially assymetrical about a central axis coincident with said rotational axis of said rotor; said pair of cam track means being located axially outwardly of said cylinders in parallel planes lying formal to said rotational axis and adjacent opposite axial ends of said rotor; plural cam rider assembly means, each having follower means engaged with said track means for following the contour thereof; and means coupling a said rider assembly means to the piston in each cylinder whereby to effect reciprocal strokes of each said piston coaxially of its associated cylinder and radially of said rotor in response to the movements of said follower means along said track means; said track means being constructed and arranged to produce distinctly dissimilar rovements of the pistons, to produce strokes of unequal duration and length during the respective intake, compression, combustion and exhaust strokes thereof.

2. The combination of claim 1 wherein each said riders assembly means effects single intake, compression, combustion and exhaust stroke movements of the said piston coupled thereto during a single revolution of said rotor.

3. The combination of claim 1 wherein said cam track means is configured to effect a single intake, compression, combustion and exhaust stroke of each piston for a single revolution of said rotor.

4. The combination of claim 1 wherein said shaft means comprises coaxial intake and exhaust passageway means, and intake and exhaust valve port means communicating between the exterior of said shaft means and said intake and exhaust passageway means, respectively, and operable to successively communicate with the combustion chamber of each said cylinder in response to rotation of said rotor and combustion chamber means about said shaft means.

5. The combination of claim 1 wherein each cam rider assembly means comprises a pair of ritid slide members slidably connected to said rotor for movement radially thereof and parallel to the movement axis of an associated piston, means traversing each cylinder for rigidly joining one end of said slide members to the radially outward end of an associated piston, and roller means mounted on the opposite end of said slide members for engaging said track means substantially opposite the radially inner end of said associated piston.

6. The combination of claim 1 wherein the point of force transfer between a said rider assembly means and said track means is adjacent the radially innermost end of the said piston coupled thereto.

7. The combination of claim 1, and spark plugs mounted in each said combustion chamber for rotational movement with said chamber means about said shaft means.

8. The combination of claim 1 wherein each said cam means comprises a pair of radially spaced cam track means each of which is engageable by one of a pair of said follower means associated with a said cam rider assembly means.

* * * * *

UNITED STATES PATENT AND TRADEMARK OFFICE

CERTIFICATE OF CORRECTION

PATENT NO. : 4,653,438

DATED : March 31, 1987

INVENTOR(S) : Robert L. Russell

It is certified that error appears in the above-identified patent and that said Letters Patent is hereby corrected as shown below:

Claim 1, column 16, line 41, after "cylindrical" add -- rotor --.

Claim 1, column 16, line 42, "acruately" should read -- arcuately --.

Claim 1, column 16, line 49, "indpendently" should read -- independently --.

Claim 1, column 16, line 68, "rovements" should read -- movements --.

Claim 5, column 17, line 23, "ritid" should read -- rigid --.

Signed and Sealed this

Twenty-ninth Day of September, 1987

*Attest:*

DONALD J. QUIGG

*Attesting Officer* *Commissioner of Patents and Trademarks*